US005355642A

United States Patent [19]

Palamarz

[11] Patent Number: 5,355,642

[45] Date of Patent: Oct. 18, 1994

[54] PREFABRICATED POST WITH DUAL MOUNTING MEMBERS

[76] Inventor: Gregory Palamarz, 3742 Broadway Street, Richmond, British Columbia, V7E 4Y8, Canada

[21] Appl. No.: 984,703

[22] Filed: Dec. 3, 1992

[51] Int. Cl.[5] ..... E04B 1/34; E04H 17/20

[52] U.S. Cl. ..... 52/73; 52/296; 52/297; 256/65

[58] Field of Search ..... 256/DIG. 5, 13.1, 19, 256/59, 65; 52/73, 296, 297

[56] References Cited

U.S. PATENT DOCUMENTS

| | | | |
|---|---|---|---|
| 2,557,002 | 6/1951 | Lathrop | 256/65 |
| 2,780,440 | 2/1957 | Krieger | 256/65 |
| 3,170,201 | 2/1965 | Nofziger | 256/19 |
| 3,233,870 | 2/1966 | Gerhardt | 256/13.1 |
| 3,233,871 | 2/1966 | Schroer | 256/65 |
| 3,486,739 | 12/1969 | Nelson et al. | 256/65 |
| 3,512,317 | 5/1970 | Lynch | 52/296 |
| 4,632,346 | 12/1986 | Wilson | 52/296 |
| 4,793,111 | 12/1988 | Shewchuck | 52/296 |

FOREIGN PATENT DOCUMENTS 2174131 10/1986 United Kingdom ..... 256/DIG. 5

*Primary Examiner*—Carl D. Friedman
*Assistant Examiner*—Christopher Todd Kent
*Attorney, Agent, or Firm*—Seed and Berry

[57] ABSTRACT

A post for mounting in a concrete slab is disclosed. The post has an elongated rigid body with a mounting end. A pair of mounting rods extend from the mounting end. The body of the post is formed from an extruded aluminum shell. The mounting rods extend through channels which are formed in the shell and are held in place in the channels by an expandable grout. The expandable grout both holds the mounting rods in the shell and acts with the mounting rods to reinforce the shell. The shell is preferably in the form of a pair of tubes joined by a web. Attachments may be made to the post with fasteners which pass through apertures in the web. The post is quick to install, may be mounted close to the edge of a concrete slab with reduced risk of damage to the edge of the slab, and is extremely rigid.

20 Claims, 3 Drawing Sheets

PREFABRICATED POST WITH DUAL MOUNTING MEMBERS

FIELD OF THE INVENTION

This invention relates to a prefabricated post which is adapted for secure mounting in a concrete slab and may be mounted near the edge of a concrete slab. Posts according to the invention are particularly, but not exclusively, useful for balcony railing support posts in concrete buildings.

BACKGROUND OF THE INVENTION

It is often useful to mount a vertical post near the edge of a concrete slab. For example, the balconies in modern apartment buildings are often formed of a concrete slab which projects from the building. To prevent people and objects from accidentally falling off such balconies, railings are provided around the balconies. Such railings are typically mounted on posts which are fastened to the concrete slab. To maximize the useful area of the balcony the balcony railing mounting posts must be attached as close as possible to the edge of the slab. Prefabricated posts may also be used to support railings on concrete stairways, railings on the sides of loading docks, and other similar fixtures to concrete structures.

Prior art prefabricated posts comprise a vertical member which forms the body of the post. The prior art offers various methods for mounting the body of the post to a concrete slab.

One method of mounting a post in a concrete slab is to drill a hole in the concrete slab large enough in diameter to accept the lower end of the body of the post. After the hole has been drilled in the concrete slab, the hole is partially filled with an expandable grout or similar material and the end of the post is placed in the hole. The grout then hardens to hold the post, in place. The lower portion of the post may have a bumpy or roughened outer surface for better retention in the hole.

A disadvantage of this mounting method is that a large hole must be drilled to mount each post. This can weaken the concrete slab, particularly if the hole is near the edge of the slab.

It is also very time consuming to drill a large hole in concrete. The time necessary to drill a hole increases very quickly as the diameter of the hole increases. Furthermore, the larger and deeper the hole the more likely it is that the drill will hit a piece of reinforcing bar in the cement slab during the drilling. If a piece of reinforcing bar is hit the hole may need to be relocated.

It must also be remembered that posts are often mounted at the edge of balconies which may be very high off the ground and are a dangerous place to work. Workers who need to drill a large number of large holes for attaching posts must spend many hours in this dangerous environment. In a residential apartment building it would not be unusual for more than one thousand posts to be installed during the construction of the building.

A second mounting means for a post provides a flat base on the lower end of the body of the post and a rigid mounting rod extending from the centre of the base. The mounting rod is grouted into place in a hole in the top surface of the slab as described above. The rod may have a bumpy or roughened outer surface for better retention in the hole. The base sits on the top surface of the slab and enhances the stability of the post.

The rod in this second variety of post may be smaller in diameter than the body of the post. The base provides some support for the post. However, the rigid mounting rod provides most of the support for the post. Because the mounting rod must be sufficiently rigid to support the post and it is not economical to make the rod from an exotic, high strength material the mounting rod is generally reasonably large in diameter.

Prior art posts of the second kind described above are typically installed near the edge of a concrete slab by drilling a hole in the top surface of the concrete slab of a size sufficient to accept the protruding rod. The balcony railing posts which are used to support balcony railings in a residential apartment building typically have mounting rods with diameters between $\frac{3}{4}$ inch and 1 inch. It is time consuming to drill the holes necessary to mount the many posts which are required to support balcony railings in a typical apartment building.

A principal difficulty with prior art posts of either of the kinds described above is that to mount the post near the edge of a concrete slab a relatively large diameter hole must be drilled close to the edge of the slab. Because the portion of the slab between the hole and the edge of the slab is relatively thin, this portion of the slab is quite fragile. If a large force is applied to the top of the post, the rod and/or the outer portion of the bottom of the vertical member may exert enough force to crack the thin portion of the concrete which forms the outer wall of the mounting hole. Even if the concrete does not fall away completely, cracks may eventually allow water to trickle into the vicinity of the rod causing the rod to rust. The accumulation of rust in the mounting hole causes additional forces on the walls of the mounting hole which may cause the layer of cement at the edge of the slab to crack away completely.

The second variety of prior art posts described above has several disadvantages. If the top surface of the slab is not level, for example, if the top surface of the slab is slanted to shed rain, then the post cannot be easily installed so that it is vertical. The base of the post must sit flat on the top surface of the slab to provide some support to the post. Secondly, because the post relies upon the base for support, the material under the base must be strong. The top surfaces of some concrete slabs are covered with a layer of relatively soft waterproof topping material. In such cases, the second variety of post should either be installed before the topping material is applied or the topping material must be removed from the surface of the slab in the area where the base of the post will sit. This makes it expensive to install such posts. Finally, it is expensive to make the second variety of post because the base and mounting rod must be attached to the body of the post, usually by welding. This is difficult to automate on a small scale.

A third variety of prior art post has a flange around the lower end of the post body. The flange has a number of holes through it. The post is attached to a cement slab by drilling relatively small holes in the slab in a pattern corresponding to the pattern of the holes in the flange, inserting anchors in the holes, inserting screws through the holes in the flange and into the anchors and tightening the screws. The steps of installing and tightening the screws make this type of post time consuming to install.

SUMMARY OF THE INVENTION

The invention provides a post for mounting in a concrete slab. The post comprises an elongated body member having a mounting end for mounting to a concrete slab, a free end, exterior surfaces and first and second sides; a first channel extending into the body member from the mounting end; a second channel parallel to the first channel extending into the body member from the mounting end; a first rod fixed in and extending from the first channel; and a second rod fixed in and extending from the second channel.

Another aspect of the invention provides a balcony comprising a concrete slab and a railing around at least a portion of the perimeter of the slab. The railing is mounted on at least one post attached to the slab. The post has a mounted end attached to the slab. The mounted end has an inner edge away from the perimeter and an outer edge toward the perimeter and attachment means to attach the post to the slab. The attachment means comprises: a first rod attached to the post and extending from the mounted end at a point toward the outer edge into a first hole in the slab; a second rod attached to the post and extending parallel to the first rod from the mounted end at a point toward the inner edge into a second hole in the slab; and an adhesive compound in the first and second holes surrounding the first and second rods. The first rod is more flexible than the second rod.

A further aspect of the invention provides a post for mounting to a concrete slab. The post comprises an elongated body formed by an extrusion having a mounting end and a free end. The extrusion comprises: a first portion in the form of a tube extending along a first side of the extrusion; a second portion parallel to the first portion, the second portion in the form of a tube extending along a second side of the extrusion; a web extending between the first and second portions along the first and second portions, the first and second portions extending past the web at the mounting end; a first longitudinal channel extending through the first portion; and a second longitudinal channel extending through the second portion. The post further comprises a first mounting rod extending along substantially the entire length of the first channel and extending from the first channel at the mounting end and a second mounting rod, more flexible than the first mounting rod, extending from the second channel at the mounting end. The first and second rods are retained in the first and second channels by an adhesive which substantially fills the portions of the first and second channels surrounding the rods.

BRIEF DESCRIPTION OF THE DRAWINGS

By way of illustration the invention will now be described with reference to the following drawings which illustrate specific embodiments of the invention but which should not be construed as restricting the scope or spirit of the invention in any way.

DETAILED DESCRIPTION OF THE PREFERRED EMBODIMENT

Figure 1:
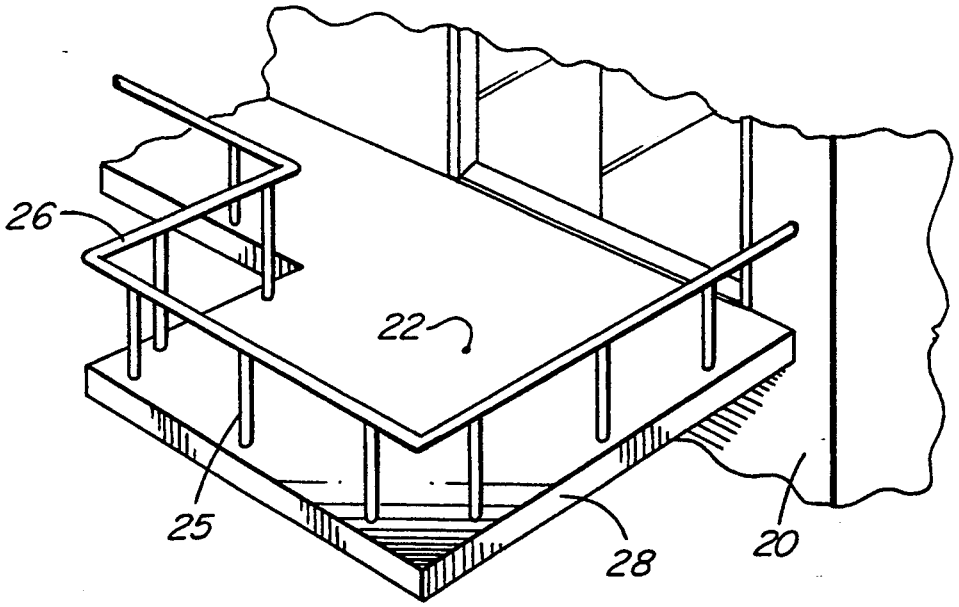
FIG. 1 is an isometric view of a balcony railing constructed of posts according to the invention.

FIG. 1 is an isometric view of a building The building has balconies formed from projecting concrete slabs 22. Railings 26 are mounted around the outer perimeters of concrete slabs 22 by means of support posts Support posts 25 must be securely fastened to slab 22 so that railings 26 are securely and firmly held in place to prevent persons or objects from accidentally falling off the edges 28 of slabs 22. The ends of railings 26 near the wall of building 20 may be attached to building 20 for extra support.

To maximize the useful area on top of slabs 22, posts 25 are preferably mounted as close to edges 28 as possible.

Figure 2A:
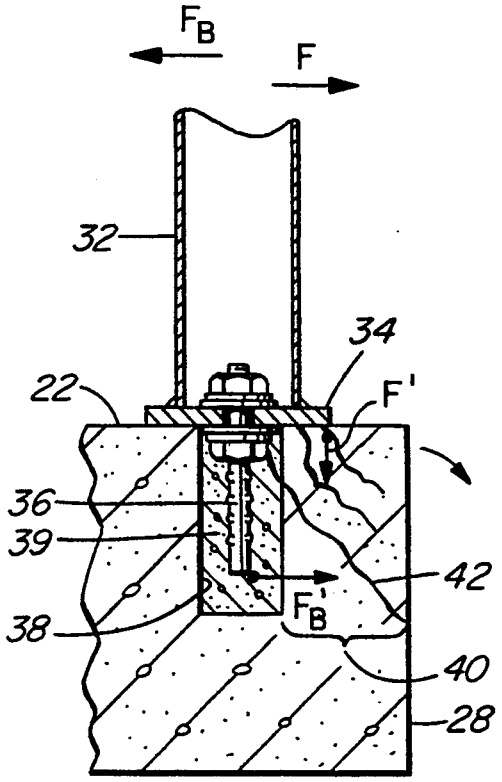
FIG. 2A PRIOR ART
FIG. 2A is a vertical section through a prior art post mounted near the edge of a concrete slab.

FIG. 2A shows a typical prior art prefabricated post 30 mounted near edge 28 of a concrete slab 22. Post 30 has a vertical body member 32, a flat base 34 at one end of body member 32 and a mounting rod 36 extending vertically downward from base 34. Base 34 is welded to body member 32. Mounting rod 36 is bolted to base 34.

Post 30 is installed in a pre-drilled hole 38 in the top surface of slab 22. Hole 38 is drilled in the desired position for mounting post 30. Hole 38 is of sufficient diameter to accept rod 36. Post 30 is installed by partially filling hole 38 with a hardenable adhesive material, such as expandable grout, and then inserting rod 36 into hole 38. The expandable grout then hardens to form a layer 39 which holds rod 36 in place in hole 38.

If post 30 is mounted near the edge of slab 22 then the portion 40 of concrete between hole 38 and edge 28 of slab 22 will be thin and therefore susceptible to breakage. With prior art posts such as post 30 this problem is made worse because rod 36 must be rigid to hold post 30 securely in place in slab 22. In a residential balcony, rod 36 may be, for example, a section of standard steel reinforcing bar ¾ of a inch in diameter.

If a force, indicated schematically by "F" in FIG. 2A, is applied near the top of post 30 in the direction of edge 28 then rod 36 will exert an outward force on the section of portion 40 near the top of edge 28. The outward force exerted by rod 36 will be greater than the force F applied to the top of post 30 because body member 32 is significantly longer than rod 36 and therefore provides significant leverage. Base 34 may also exert a downward force on the top of portion 40. The tremendous forces which can be developed in portion 40 may cause a section of portion 40 to crack away, along cracks 42.

Even if a section of portion 40 does not crack away completely, cracks 42 formed in portion 40 may allow water to seep down from the top of slab 22 and through edge 28 into the vicinity of rod 36. Rod 36 may then rust. The rust accumulating around rod 36 can cause further stresses on the concrete surrounding hole 38, and therefore may cause further cracking.

A further disadvantage of some prior art posts is that water may seep into the vicinity of rod 36 by seeping along the top surface of slab 22 beneath base 34 and then into hole 38. This can lead to rusting of rod 36.

Figure 2B:
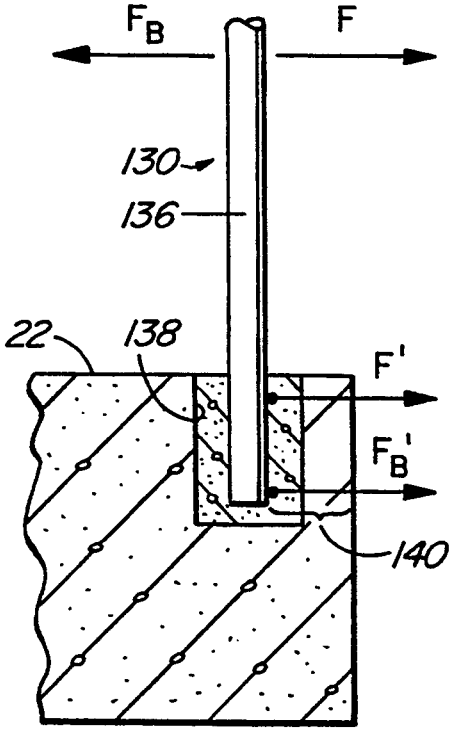
FIG. 2B PRIOR ART
FIG. 2B is a vertical section through an alternative prior art post mounted neat the edge of a concrete slab.

FIG. 2B shows an alternative variety of prior art post 130. Post 130 is formed of a single relatively large diameter rod 136. Post 130 is mounted by securing its lower portion in a hole 138 which is drilled in the top surface 22 of a concrete slab with a hardenable adhesive such as an expandable grout. Hole 138 must be larger than rod 136.

In balcony railing construction, it is preferable that holes 38 or 138 for mounting posts as shown in FIGS. 2A and 2B not be closer than approximately 15 cm to edges 28 of slab 22. If holes 38 (or 138) are much closer to edges 28 then there is an increased risk that area 40 (or 140) of slab 22 will crack when a force F is applied to the top of post 30 (or 130).

Figure 3:
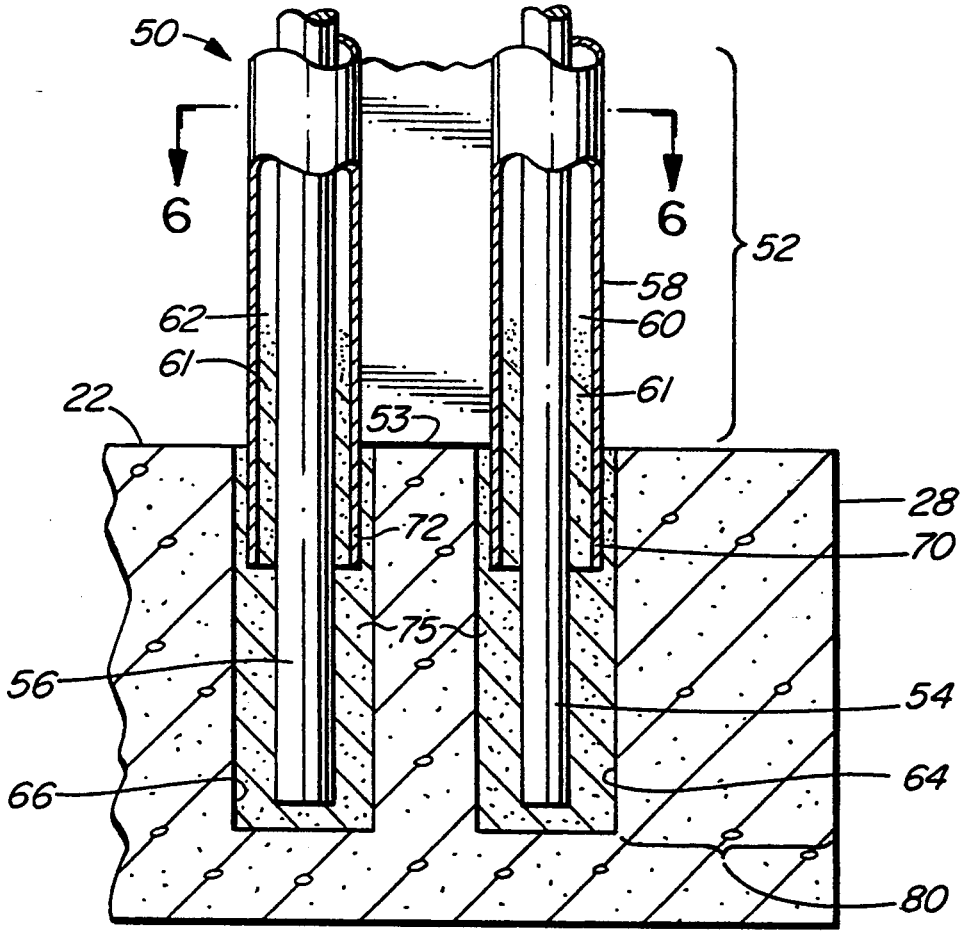
FIG. 3 is a vertical section through a post according to the invention mounted near the edge of a concrete slab.

FIG. 3 shows the mounting portion of a post 50 according to the invention. Post 50 has a vertical body member 52 with a mounting end 53 and a free end (not shown), a first rod 54 extending from mounting end 53 and a second rod 56 extending from mounting end 53 parallel to first rod 54.

Body member 52 preferably comprises a thin extruded aluminum shell 58. Rods 54, 56 extend through channels 60, 62 in shell 58 to reinforce body member 52. While channels 60, 62 may be round bores formed during the process of extruding aluminum shell 58, channels 60, 62 are not necessarily circular in section.

Rods 54 and 56 are held in place in channels 60, 62 by an expandable grout or other suitable adhesive. The adhesive fills the portions 61, 63 of channels 60, 62 around rods 54 and 56. The adhesive both retains rods 54 and 56 in channels 60, 62 and acts together with rods 54 and 56 to reinforce shell 58. It has been found that the expandable grout manufactured under the trade-mark ROCKTITE by Hariline Products Co. Inc. of Cleveland, Ohio, U.S.A. is a suitable adhesive material for this purpose.

Rods 54, 56 may be conventional steel reinforcing rods. The reinforcement provided by rods 54, 56 make it possible to make shell 58 from thinner aluminum then would be necessary if body member 52 were completely formed of aluminum. Because aluminum is an expensive material relative to the cost of steel reinforcing rods, the reinforced construction according to the invention may present a considerable cost saving over conventional aluminum posts of equal strength while providing a post that is more attractive and more resistant to weathering than a post which is entirely made of steel or reinforced concrete. The walls of channels 60, 62 preferably extend slightly past mounting end 53 of body member 52 to form collars 70, 72.

Post 50 may be installed in slab 22 near edge 28 by pre-drilling a pair of spaced holes, 64, 66. The spacing of holes 64, 66 is equal to the spacing of rods 54, 56. Hole 64 is of sufficient diameter to accommodate rod 54. The top portion of hole 64 is preferably large enough in diameter to accommodate collar 70 and may have a countersunk portion (not shown) to accept collar 70. The top portion of hole 66 is preferably large enough in diameter to accept collar 72 and may have a countersunk portion (not shown) to accept collar 72.

Because rods 54, 56 are each significantly smaller than the single mounting rod 36 which would be used in a prior art post of similar strength, holes 64, 66 are significantly smaller than the hole 38 which would be required to mount a prior art post as shown in either of FIGS. 2A or 2B. Small holes are much easier to drill in a concrete slab than large holes. Although each post according to the invention requires a pair of holes 64, 66 to be drilled, it is quicker and easier to drill such holes than it is to drill a single large hole 38.

Post 50 is mounted in holes 64, 66 by placing a suitable adhesive material such as expandable grout in holes 64, 66 and lowering rods 54, 56 into holes 64, 66 respectively. The expandable grout then hardens forming layers 75 of hardened grout which fasten rods 54, 56 to slab 22. Because collars 70, 72 extend into hole 64, 66 which are filled with hardened grout, the likelihood of water seeping along mounting end plate 53 and coming into contact with either rod 54, 56 is very small.

Rod 54 is preferably thinner and more flexible than rod 56. For example, in a residential balcony railing application, rod 54 may be a standard steel reinforcing bar $\frac{1}{4}$ inch in diameter while rod 56 may be a steel reinforcing bar $\frac{1}{2}$ inch in diameter. Rod 54 may also be a flat strap mounted with a flat face facing rod 56 so that it can bend relatively easily toward and away from rod 56. Neither rod 54 nor 56 need be as large in diameter as the single rod which is used in prior art prefabricated posts as described above with reference to FIGS. 2A and 2B.

While rod 54 is preferably thinner and more flexible than rod 56 along the length of the portion of rod 54 which projects from the body of post 50, some of the advantages of the invention may be obtained by making rod 54 of similar dimensions to rod 56 but of a more flexible material. Similarly, while it is not preferred, as shown in FIG. 5, rods 54 and 56 may have similar dimensions and may be made of the same material if rod 54 is weakened at a point near the lower end of collar 70.

Figure 5:
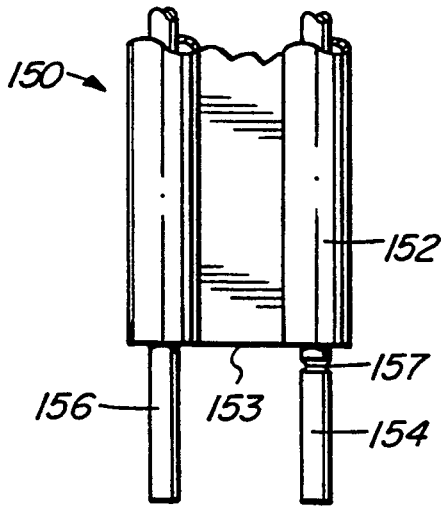
FIG. 5 is an elevation of the mounting end of an alternative post according to the invention.

FIG. 5 is an elevation of a post 150 according to the invention. Post 150 has an elongated body member 152 having a free end (not shown) and a mounting end 153. Rods 154 and 156 project from mounting end 153. Rods 154 and 156 are of equal diameter. Rod 154 has a weakened portion 157 adjacent to mounting end 153. If a large force is applied to the top of post 150 then rod 154 will tend to bend at weakened portion 157 rather than apply a large force to the concrete surrounding rod 154.

The design of the post according to the invention allows the post to be mounted relatively close to edge 28 of slab 22 with a reduced risk that edge 28 will be damaged by forces applied to post 50. In some cases, a post 50 for supporting a residential balcony railing may be safely mounted with hole 64 as close as 4 cm to the edge 28 of a slab 22.

Figure 4:
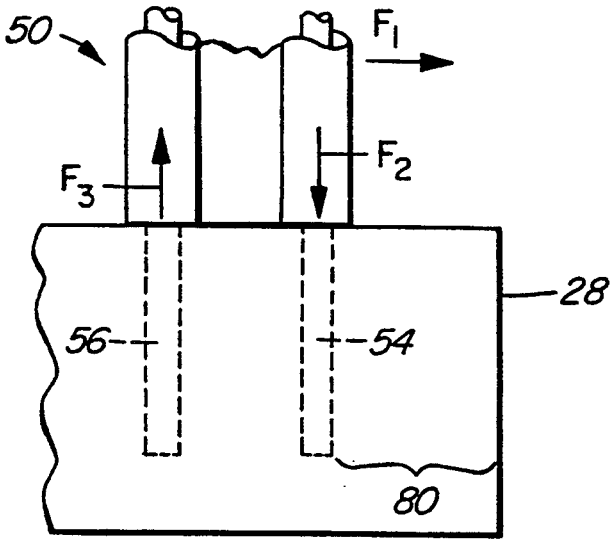
FIG. 4 is a schematic diagram showing the distribution of forces applied to a concrete pad when a force is applied to the top of a post according to the invention.

FIG. 4 is a schematic view of the distribution of forces which are applied to slab 22 by post 50 when a force, indicated schematically by $F_1$, is applied to a point near the top of post 50 in the direction of edge 28. Force $F_1$ results in a downward force $F_2$ on the top of slab 22 at the outer part of mounting end 53 near edge 28 and an upward force $F_3$ on rod 56. Downward force $F_2$ is spread over rod 54 and the area of the outer part of mounting end 53. Rod 56 is well capable of resisting upward force $F_3$. Force $F_2$ is resisted by rod 54 and by the top surface of slab 22 under the outer part of mounting end 53. Force $F_3$ is resisted by the adhesion of rod 56 in hole 66. Thus, the design of post 50 causes outward forces applied to the top end of post 50 to act on slab 22 primarily as vertical forces and not as a large outward force on any part of the portion 80 of slab 22 which lies between hole 64 and edge 28.

Rod 54 is also prevented from delivering large lateral forces to portion 80 because rod 54 is relatively flexible, and therefore incapable of transmitting a large lateral force to portion 80 of slab 22.

Rod 56, which is significantly more rigid than rod 54, takes most of the lateral force. Because rod 56 is mounted at the inward edge of post 50, the concrete surrounding rod 56 is thicker and therefore better able to take lateral forces than the concrete surrounding rod 54. This is unlike the mounting of a conventional post in which the only support rod is mounted near the centre of the post to provide support for the post against forces in any direction.

Some further advantages of the post shown in FIG. 3 are that it can be manufactured without any welding because the body of the post 50 may be formed from a single extrusion 58. Furthermore, because post 50 is primarily supported by rods 54, 56 and not by mounting end 53, post 50 can be mounted vertically on a non-horizontal slab by drilling holes 64, 66 vertically and not perpendicular to the surface of the slab. Post 50 may be mounted on a concrete slab which is covered with a soft topping mixture by extending holes 64, 66 through the topping mixture into the hard concrete beneath.

Figure 6:
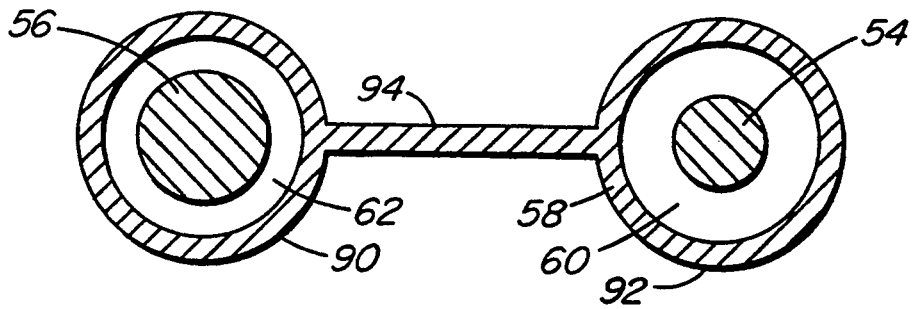
FIG. 6 is a section through the body of a prefabricated post according to the invention.

FIG. 6 is a horizontal cross section along the line 6—6 through post 50 which is shown in FIG. 3. Extrusion 58 is generally dumbbell shaped in section. The inner side 90 and the outer side 92 of extrusion 58 are formed as a pair of parallel tubes having bores 60, 62. Inner side 90 and outer side 92 are joined together along their length by a web 94. Rods 54 and 56 extend along bores 60, 62. Collars 70, 72 (FIG. 3) may be formed by trimming away web 94 near mounting end 53.

Post 50 retains almost all of its rigidity when holes are drilled through web 94. Therefore, rails and other attachments may be attached to post 50 by means of fasteners which pass through holes in web 94 without significantly weakening post 50. This is a significant advantage over those prior art posts which rely for their strength on the integrity of their outer skins. A further advantage of the construction shown in FIG. 6 is that water cannot enter bores 60, 62 through a hole drilled in web 94.

Figure 7:
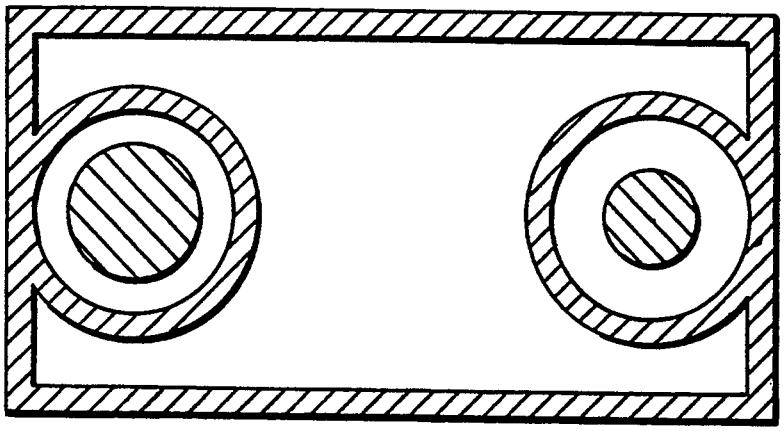
FIG. 7 is a section through the body of an alternative embodiment of a prefabricated post according to the invention.

FIG. 7 is a horizontal section through an alternative post according to the invention. It is possible to make posts according to the invention of many varying cross sections.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A post for mounting in a concrete slab, said post comprising:

(a) an elongated body member having a mounting end for mounting to a concrete slab, a free end, exterior surfaces and first and second sides;

(b) a first channel adjacent to said first side of said body member extending into said body member from said mounting end;

(c) a second channel adjacent to said second side of said body member parallel to said first channel extending into said body member from said mounting end;

(d) a first rod fixed in and extending from said first channel; and (e) a second rod fixed in and extending from said second channel wherein said first rod is smaller in diameter than said second rod.

2. The post of claim 1 wherein said first rod is fixed in said first channel by an adhesive material.

3. The post of claim 2 wherein said first channel extends substantially along the length of said body member and said first rod extends substantially along the length of said first channel to reinforce said body member and said adhesive material substantially fills said first channel around said first rod.

4. The post of claim 3 wherein said second channel extends substantially along the length of said body member and said second rod extends substantially along the length of said second channel to reinforce said body member and said adhesive material substantially fills said second channel around said second rod.

5. The post of claim 3 wherein said body member comprises a metallic extrusion, said channels are formed integrally with said metallic extrusion and said metallic extrusion forms the exterior surfaces of said body member.

6. The post of claim 5 wherein said extrusion has the form of a pair of parallel tubes, the bores of said tubes comprising said first and second channels, said tubes joined by a web of material which extends between said tubes along substantially their length.

7. The post of claim 2 wherein said adhesive material is a grout.

8. A post for mounting in a concrete slab, said post comprising:

(a) an elongated body member having a mounting end for mounting to a concrete slab, a free end, exterior surfaces and first and second sides;

(b) a first channel extending into said body member from said mounting end;

(c) a second channel parallel to said first channel extending into said body member from said mounting end;

(d) a first rod fixed in and extending from said first channel; and (e) a second rod fixed in and extending from said second channel wherein said first rod is fixed in said first channel by an adhesive material: said first channel extends substantially along the length of said body member and said first rod extends substantially along the length of said first channel to reinforce said body member; said adhesive material substantially fills said first channel around said first rod; said body member comprises a metallic extrusion said channels are formed integrally with said metallic extrusion and said metallic extrusion forms said exterior surfaces of said body member; and, said body member further comprises a first collar extending from said mounting end and encircling said first rod and a second collar extending from said mounting end and encircling said second rod.

9. The post of claim 8 wherein said first and second collars are integral with said extrusion and are extensions of said channels.

10. The post of claim 8 wherein said second rod is fixed in said second channel by a adhesive material.

11. The post of claim 10 wherein said adhesive material is a grout.

12. A post for mounting in a concrete slab, said post comprising:

(a) an elongated body member having a mounting end for mounting to a concrete slab, a free end, exterior surfaces and first and second sides;

(b) a first channel extending into said body member from said mounting end;

(c) a second channel parallel to said first channel extending into said body member from said mounting end;

(d) a first rod fixed in and extending from said first channel; and (e) a second rod fixed in and extending from said second channel wherein said first rod is more flexible than said second rod.

13. The post of claim 12 wherein the portion of said first rod which extends from said first channel has a weakened section adjacent to said mounting end of said body.

14. In a means for attaching a post for supporting a balcony railing to a balcony wherein said balcony comprises a concrete slab and said railing extends along at least a portion of the perimeter of said slab, said railing is mounted to said post, said post is attached to said slab at a position along said perimeter and has a mounted end attached to said slab, said mounted end having an inner edge away from said perimeter and an outer edge toward said perimeter an improvement comprising:

(a) a first rod attached to said post and extending from said mounted end at a point toward said outer edge into a first hole in said slab;

(b) a second rod attached to said post and extending parallel to said first rod from said mounted end at a point toward said inner edge into a second hole in said slab; and (c) an adhesive compound in said first and second holes surrounding said first and second rods;

wherein said first rod is more flexible than said second rod.

15. A post for mounting to a concrete slab, said post comprising:

(a) an elongated body formed by an extrusion having a mounting end and a free end, said extrusion comprising: a first portion in the form of a tube extending along a first side of said extrusion; a second portion parallel to said first portion, said second portion in the form of a tube extending along a second side of said extrusion; a web extending between said first and second portions along said first and second portions, said first and second portions extending past said web at said mounting end; a first longitudinal channel extending through said first portion; and a second longitudinal channel extending through said second portion;

(b) a first mounting rod extending along substantially the entire length of said first channel and extending from said first channel at said mounting end; and (c) a second mounting rod, more flexible than said first mounting rod, extending from said second channel at said mounting end;

wherein said first and second rods are retained in said first and second channels by an adhesive which substantially fills the portions of said first and second channels surrounding said rods.

16. A post for mounting in a concrete slab, said post comprising:

(a) an elongated body member having a mounting end for mounting to a concrete slab, a free end, exterior surfaces and first and second sides;

(b) a first channel extending into said body member from said mounting end;

(c) a second channel parallel to said first channel extending into said body member from said mounting end;

(d) a first rod fixed in and extending from said first channel;

(e) a second rod fixed in and extending from said second channel; and (f) a first collar extending from said mounting end and encircling said first rod.

17. The post of claim 16 further comprising a second collar extending from said mounting end and encircling said second rod.

18. The post of claim 17 wherein said body member comprises a metallic extrusion, said channels are formed integrally with said metallic extrusion and said metallic extrusion forms said exterior surfaces of said body member.

19. The post of claim 18 wherein said extrusion comprises a pair of parallel tubes, the bores of said tubes comprising said first and second channels, said tubes joined by a web of material which extends between said tubes along substantially their length wherein said first and second collars are integral with said extrusion and are extensions of said channels.

20. A post for mounting in a concrete slab, said post comprising:

(a) an elongated body member having a mounting end for mounting to a concrete slab, a free end, exterior surfaces and first and second sides;

(b) a first channel extending into said body member from said mounting end;

(c) a second channel parallel to said first channel extending into said body member from said mounting end;

(d) a first rod fixed in and extending from said first channel; and (e) a second rod fixed in and extending from said second channel wherein said first rod is smaller in diameter than said second rod.

* * * * *